US005407374A

United States Patent [19]

Sullivan et al.

[11] Patent Number: 5,407,374

[45] Date of Patent: Apr. 18, 1995

[54] STEP-IN WATER SKI BINDING

[76] Inventors: James M. Sullivan, 481 Riverside Ave., Westport, Conn. 06880; Charles R. Sherts, 70 Washington St. #302, Norwalk, Conn. 06854

[21] Appl. No.: 155,593

[22] Filed: Nov. 22, 1993

[51] Int. Cl.[6] ..... A63C 15/06

[52] U.S. Cl. ..... 441/70

[58] Field of Search ..... 441/70; 280/611, 623, 280/626, 627, 631, 632

[56] References Cited

U.S. PATENT DOCUMENTS

| | | | |
|---|---|---|---|
| 3,090,978 | 5/1963 | Hanson | 9/310 |
| 3,097,376 | 7/1963 | Forsman | 9/310 |
| 3,231,911 | 2/1966 | Clifton | 9/310 |
| 3,254,352 | 6/1966 | Lockwood | 9/310 |
| 4,131,963 | 1/1979 | Johnson | 441/70 |
| 4,718,873 | 1/1988 | Shaw et al. | 441/70 |
| 4,863,408 | 9/1989 | Lewis | 441/70 |

*Primary Examiner*—Stephen P. Avila

[57] ABSTRACT

A water ski has an automatic step-in binding which remains open while a skier is being pulled from the water and closes when the skier steps into the binding after being pulled from the water. The rear closure of the step-in binding pivots around an axis at the heel when the skier enters the binding, and is engaged by a latch which secures the rear closure in a closed position. Alternatively, the rear closure of the step-in binding includes a heelpiece which moves slidably along a track. The heelpiece is moved slidably along the track by a spring which is released when the skier steps into the binding by a trigger assembly and trigger lip.

11 Claims, 5 Drawing Sheets

STEP-IN WATER SKI BINDING

TECHNICAL FIELD

This invention relates to foot bindings for water skis, and more particularly to a water ski foot binding with an automatic step-in closure mechanism.

BACKGROUND OF THE INVENTION

Water skiing is a popular sport in which many people engage, both recreationally and competitively. Generally speaking, water skiing can be done on either one or two skis. Beginning skiers tend to use two skis, as it is easier for the skier to be pulled out of the water, and balance while being so pulled, with the greater ski surface area. More advanced skiers and slalom competition skiers tend to prefer one ski. While it is more difficult to be pulled out of the water on one ski, the single ski offers greater maneuverability and tighter turning than two skis once the skier is planing on the surface of the water. The type of bindings used has, until now, been determined by the number of skis used.

When two skis are used, both skis have full bindings including both toe and heel closures. These closures fit tightly around the foot, and it requires substantial effort for a skier to secure a foot in a binding. The securing routine can only be accomplished while the skier is in a resting position. Importantly, however, the combination of the toe and heel closure offers the skier substantial support and intimate connection to the ski. As such, the skier is unlikely to slip out of the binding unintentionally, except after falling. Also, the skier has appreciable control over the ski.

When a single ski is used, the ski has two bindings: front and rear. However, only one of these bindings includes both toe and heel closures. Typically, the front binding includes both toe and heel closures. Such a front binding is, in most respects, identical to the bindings used when two skis are utilized. Except in some competitive skis which have a rear binding identical to the front binding which must be secured while at rest in the water, however, the rear binding includes only a toe closure. The reason that the rear binding has only a toe closure has to do with the technique a skier must use to be pulled out of the water.

To be pulled out of the water on one ski, the skier first secures one foot in the front binding. The skier then places the free foot in an area towards the rear of the ski substantially behind the ear binding. The skier is then pulled out of the water. As the skier is being pulled from the water, a great deal of force is applied to the ski due to water resistance. This force must be countered by the skier, and tends to make maintaining balance difficult. Once skiing on the surface of the water, the skier moves the free foot forward into the toe closure of the rear binding. This technique is used because the skier has greater balance and can more easily exert counter force on the ski when the feet are further apart. While some advanced skiers possess the skill and strength required to be pulled from the water while secured in two full bindings, the task is beyond the capability of most skiers.

DISCLOSURE OF THE INVENTION

The present invention is predicated, in part, upon the observation that skiers who use a single ski will benefit from greater control and support by having a rear binding with both toe and heel closures.

An object of the present invention to provide a water ski binding which requires little effort to secure to the foot of the skier.

Another object of the present invention is to provide a water ski binding which requires little effort to intentionally release from the foot of the skier.

Yet another object of the present invention is to provide a water ski binding having both front and rear closures which can be entered while the skier is skiing on the surface of the water.

Still yet another object of the present invention is to provide a rear water ski binding for a single ski which provides improved support and contact with the ski.

According to the present invention, a water ski binding for a water ski includes a toe piece, a pivotal heelpiece having a base with a forward area and an aft area, a pivot axis in said aft area, a substantially rigid lip in said forward area, and a pivotal latch operationally connected with the ski such that said latch secures said heelpiece by said lip when said lip is moved past said latch. In further accord with the present invention, a water ski has a binding having an open position where a skier's foot may enter said binding and a closed position where the foot is secured in said binding, the skier's foot having a front and a rear, comprising means for securing the front of the foot to the ski; means for securing the rear of the foot to the ski, said rear foot securing means slidably movable along the ski; means for applying force to slidably move said rear foot securing means toward said front foot securing means; and means for temporarily securing said rear foot securing means in the open position, said temporary securing means releasable when the heel of the foot enters said binding, thus releasing said rear foot securing means to the closed position.

A principle feature of the present invention is the pivotal heelpiece that remains open when the skier is being pulled out of the water and secures the skier's foot in place when the skier steps into the binding after being pulled from the water. The skier is thus offered the advantages of improved support and connection with the ski that comes with combined front and rear closures without the burden of being pulled out of the water with both feet secured in full bindings.

Another principle feature of the present invention is the relatively small number of moving parts required to create a step-in type binding. Advantages which are precipitated by the small number of moving parts include reliability and low cost of manufacture.

Yet another principle feature of the present invention is the slidable heelpiece which is automatically secured against the skier's foot when the skier enters the binding. The skier is thus again offered the advantages of improved support and connection with the ski that comes with combined front and rear closures without the burden of being pulled out of the water with both feet secured in full bindings.

A principle advantage of the slidable heelpiece is that it obviates the need for the skier to adjust the binding to a specific foot size. As the skier steps into the slidably operated step-in binding, the heel of the binding slides forward against the heel of the skier and secures itself in place. The slidably operated binding thus automatically adjusts to any foot size.

Another advantage of the present invention is to add lateral stability to the heel. This added stability is provided by both the pivotal and slidable heelpiece.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
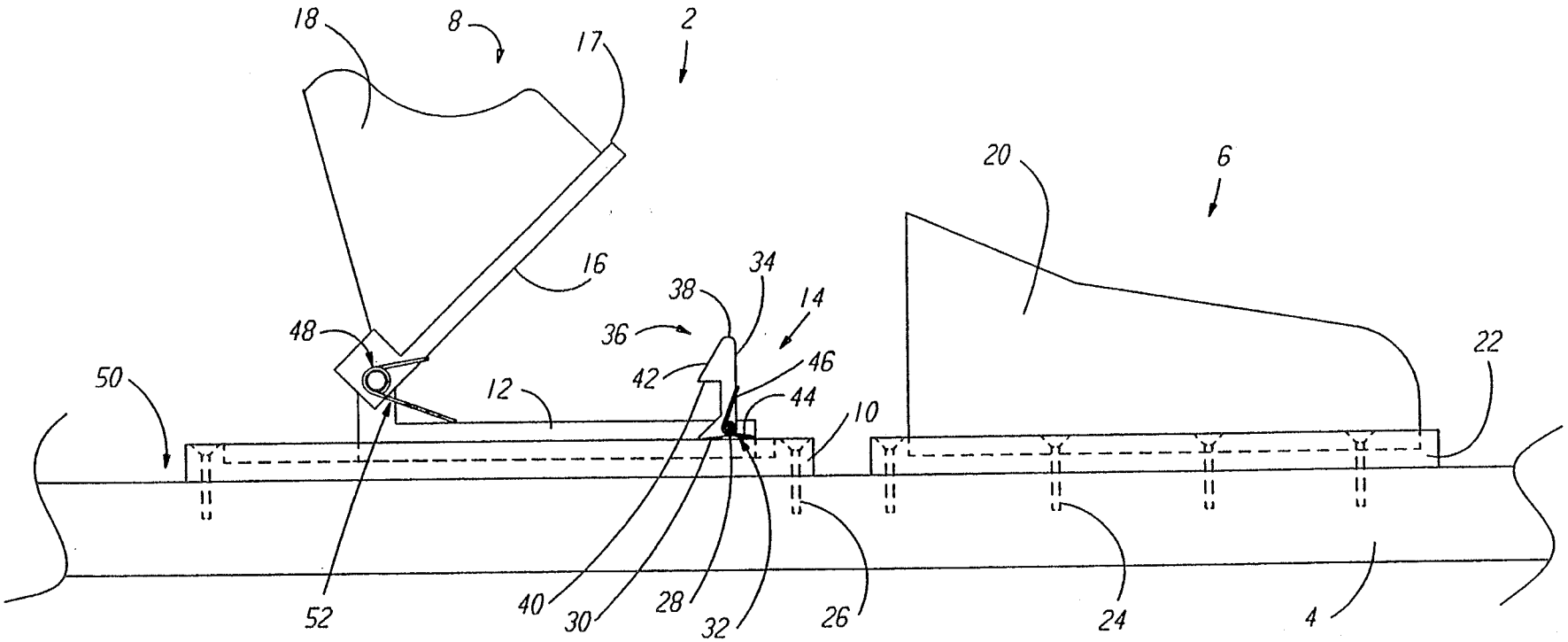
FIG. 1 is a partially cut away side view of a pivotal step-in binding according to the present invention.

FIG. 1 is a side view showing underlying features of a pivotal step-in binding 2 according to the present invention. The binding 2 is shown attached to a water ski 4. The binding 2 includes a toepiece 6 and a heelpiece 8. The heelpiece 8 includes a track plate 10, a heel base 12, a latch 14, a retaining plate 16 with a lip 17, and a flexible heel upper 18.

The toepiece 6 includes a flexible toe upper 20 and a U-shaped clamp 22. The toepiece 6 is permanently secured in position to the ski 4. The flexible toe upper 20 is secured around its edges by the U-shaped clamp 22, which overlaps the edges of the upper 20. The U-shaped clamp 22 is secured to the ski 4 by a plurality of bolts 24 which pass through the clamp 22 into the ski 4. Such a toepiece 6 is substantially similar to other toepieces and is well known in the art.

The track plate 10 is permanently secured in position to the ski 4 aft of the toepiece 6. The track plate 10 is secured to the ski 4 by a plurality of bolts 26. The heelpiece 8 is disposed upon the track plate 10 such that the heelpiece 8 can move slidably along the track plate 10 to adjust the binding 2 for different foot sizes. The heelpiece 8 is temporarily securable at various discreet points (not illustrated) along the track plate 10 by means well known in the art for the purposes of such adjustment.

The heelpiece 8 includes the heel base 12, the latch 14, the retaining plate 16 and the heel upper 18. The heelpiece 8 is operationally connected to the track plate 10 by the heel base 12. The heel base 12 is slidably connected to the track plate 10.

Figure 2:
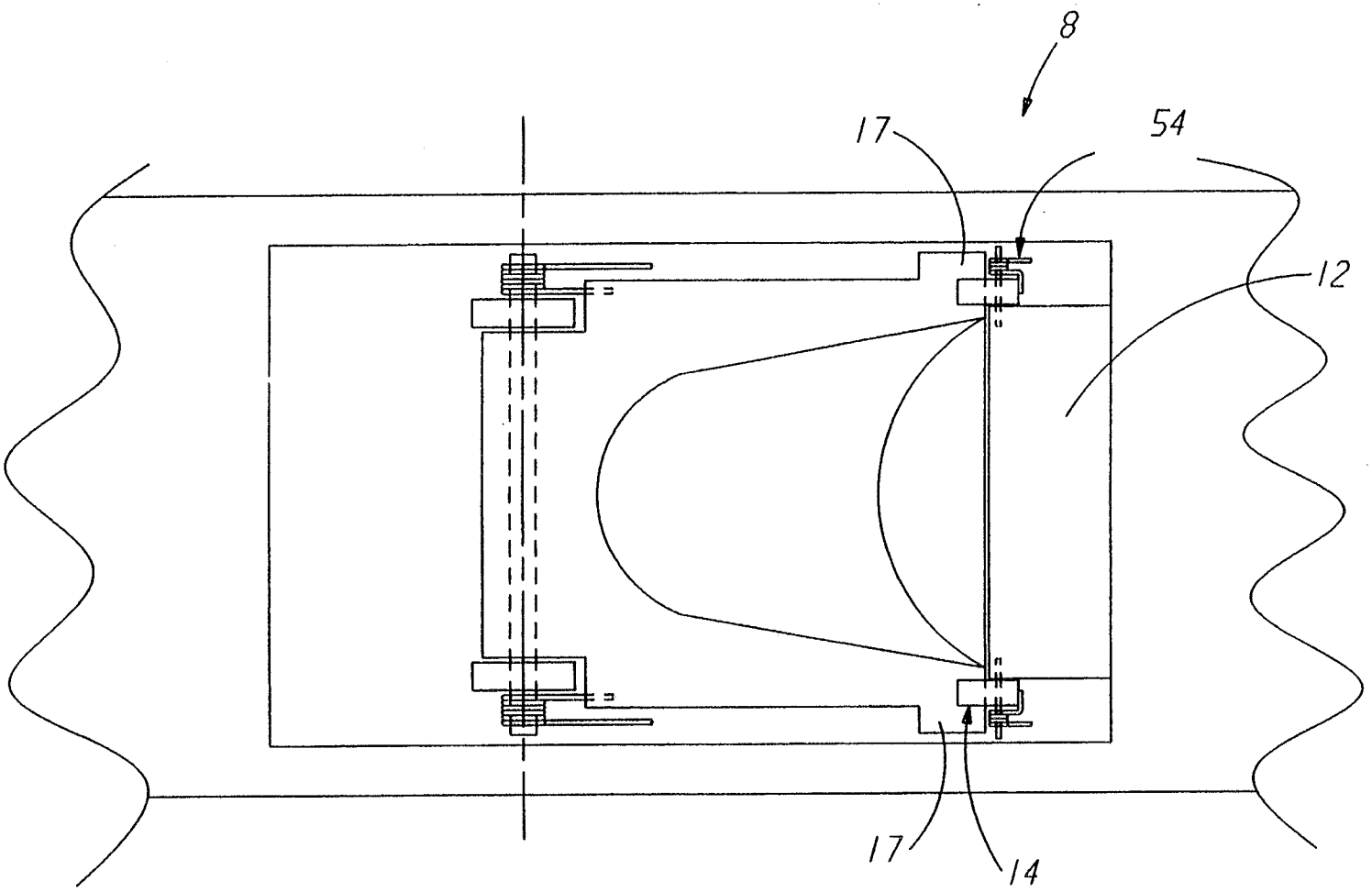
FIG. 2 is a plan view showing underlying structure of the pivotal step-in binding of FIG. 1.

The latch 14 is pivotally connected to the heel base 12 and functions to secure the heelpiece 8 in a closed position (shown in FIG. 2). The latch 14 includes an axle 28, a stop 30, a latch spring 32, and a finger-like projection 34 with a tooth member 36 having a tip 38. The latch 14 is disposed upon the heel base 12 such that the latch 14 moves slidably along the track plate 10 with the heel base 12. The axle 28 is disposed through the heel base 12 such that the finger-like projection 34 pivots around the axle 28. The finger-like projection 34 is operationally connected to the axle 28 such that the projection 34 is pivotal around the axle 28. The finger-like projection 34 protrudes radially outward from the axle 28. The tooth member 36 is disposed upon the tip 38 of the finger-like projection 34. The tooth member 36 slopes downwardly and outwardly, starting at the tip 38, to a securing edge 40, thereby forming a contact slope 42. The securing edge 40 meets the finger-like projection 34 at an angle (not specifically illustrated) of approximately 90 degrees. The stop 30 protrudes outwardly from the latch 14 and limits the pivotal range of the latch 14 toward the heel base 12. The stop 30 is positioned on the latch 14 such that when the latch 14 is pivoted so that the stop 30 is in contact with the heel base 12 and the retaining plate 16 is pivoted toward the heel base 12, the lip 17 contacts the contact slope 42, and not the tip 38. The latch spring 32 has a first end 44 and a second end 46. The first end 44 is disposed upon the heel base 12. The second end 46 is disposed upon the finger-like projection 39. The latch spring 32 functions to apply force against the finger-like projection 34 to assure that the latch 14 is in the proper position to accept the lip 17, and further assure that the latch 14 pivots over the lip 17 when the binding 2 is closed. The latch 14 also provides lateral stability to the retaining plate 16 when in a closed position.

A hinge 48 is operationally connected to the heel base 12 and the retaining plate 16. The hinge 48 is disposed rearward of the heel base 12 and retaining plate 16 such that the retaining plate 16 is pivotal around the hinge 48 from a position (shown in FIG. 2) substantially parallel to the ski 4, toward a rear 50 of the ski 4, and back. A hinge spring 52 is operationally connected to the heel base 12 and the retaining plate 16. The hinge spring 52 functions to maintain the binding 2 in an open position (as shown in FIG. 1) while the skier is being pulled from the water. The hinge spring 52 applies force against the retaining plate 16 such that the retaining plate 16 pivots up and away from the heel base 12 when the latch 14 is disengaged. The hinge spring 52 must have sufficient force to hold the retaining plate 16 away from the latch 14 when the latch 14 is disengaged, and thereby allow the skier's foot to enter the binding 2. Those skilled in the art will appreciate that the hinge 48 may be fabricated from a single piece of flexible plastic. Such a plastic hinge would obviate the need for the hinge spring 52, provided the plastic hinge has sufficient torsional strength and memory.

The retaining plate 16 is operationally connected to the hinge 48 and the flexible heel upper 18. The retaining plate 16 is connected to the upper 18 by clamping between two U-shaped plates (not specifically illustrated) which are held with screws (not illustrated). The retaining plate 16 is formed to accept the heel of the foot of the skier (not illustrated), and pivots downward, toward the ski.4., as the skier steps into the heelpiece 8. As the retaining plate 16 pivots downward, the lip 17 of the retaining plate 16 contacts the contact slope 42 of the latch 14. As continued downward force is applied, the force of the lip 17 against the contact slope 42 causes the latch 14 to pivot away from the retaining plate 16 until the lip 17 of the retaining plate 16 slides below the securing edge 40. The latch 14 then pivots back under the force of the latch spring 32 so that the securing edge 40 is positioned securingly over the lip 17.

The flexible heel upper 18 is disposed on the retaining plate 16 and so pivots therewith. The upper 18 is formed to accept and support the heel and lower rear portion of the foot of the skier (not illustrated).

FIG. 2 is a plan view showing underlying structure of the heelpiece 8 of the pivotal step-in binding of FIG. 1. This view illustrates a second latch 54 which, along with the first latch 14, provides added lip 17 engagement strength when the heelpiece 8 is in the closed position. The second latch 54 is disposed upon the heel base 12 in the same manner as the latch 14 described hereinbefore with reference to FIG. 1.

Figure 3:
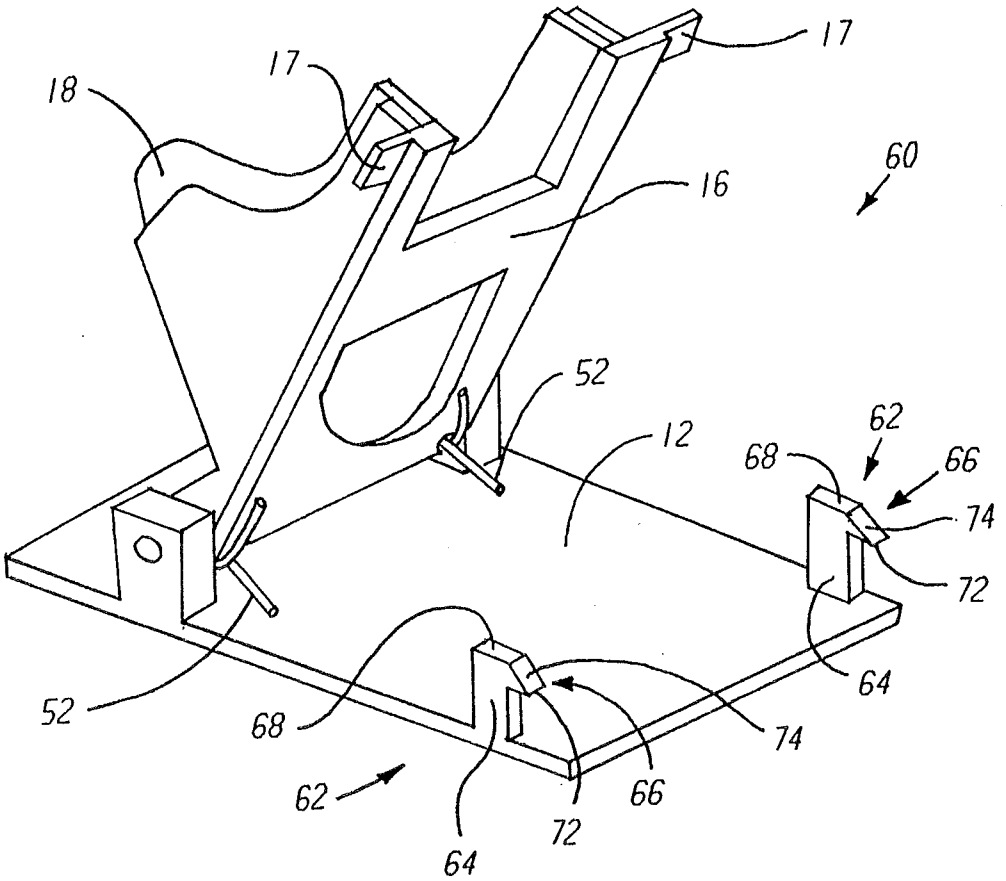
FIG. 3 is an isometric view of an alternative embodiment of a pivotal step-in binding according to the present invention.

FIG. 3 is a perspective view of an alternative embodiment of a pivotal step-in binding heelpiece 60. The heelpiece 60 is here shown in an open position. The heelpiece 60 includes a pair of single piece finger-latches 62 which are disposed upon the heel base 12. Each finger-latch 62 includes a finger 64 with a tooth 66. The finger-latches 62 are disposed upon the heel base 12 such that the latches 62 move slidably along the track plate 10 (FIG. 1) with the heel base 12. The tooth 66 is disposed upon a tip 68 of each finger 64. The tooth 66 slopes downwardly and outwardly, starting at the tip 68, to a securing edge 72. The securing edge 72 meets the finger 64 at an angle of approximately 90 degrees. The finger-latches 62 are disposed upon the heel base 12 such that the lip 17 contacts a slope 74 of the finger-latches 62 when the lip 17 is pivoted downward against the finger-latch 62. The finger-latches 62 are constructed of a semi-rigid plastic which moves torsionally away from the lip 17 as the lip 17 is forced against the finger-latches 62. The finger-latches 62 have sufficient memory the finger-latches 62 and their teeth 66 will snap into a securing position, over the lip 17, when the lip 17 is moved pivotally past the securing edge 72.

Turning now to FIGS. 1 and 3, there are two ways in which the skier may exit either embodiment of the pivotal step-in binding. The first occurs when the skier falls while skiing. The second occurs when the skier intentionally stops skiing. The upper 18 is constructed of a flexible material, such as plastic or vinyl. The upper 18 thus provides support to the skier's foot, but will not prevent the skier's foot from exiting the binding when a great deal of forward/upward or lateral force is applied to the foot. Such force is typically applied to the foot as the skier falls at speed. Thus, the upper 18 flexes to allow the foot to release from the binding during a fall. More particularly, while the binding remains closed, the foot pulls out of the binding.

In order to exit the binding following a successful ski run, the skier first comes to rest in the water. While at rest in the water, the skier's foot exerts little force upon the retaining plate 16. The skier then pivots the latch or latches 14, 54, 62 away from the lip 17 with the skier's fingers. Once the latches 14, 54, 62 disengage the lip 17, the heelpiece 8, 60 pivots toward the open position by the force of the hinge spring 52 and the skier may easily exit the binding.

Figure 4:
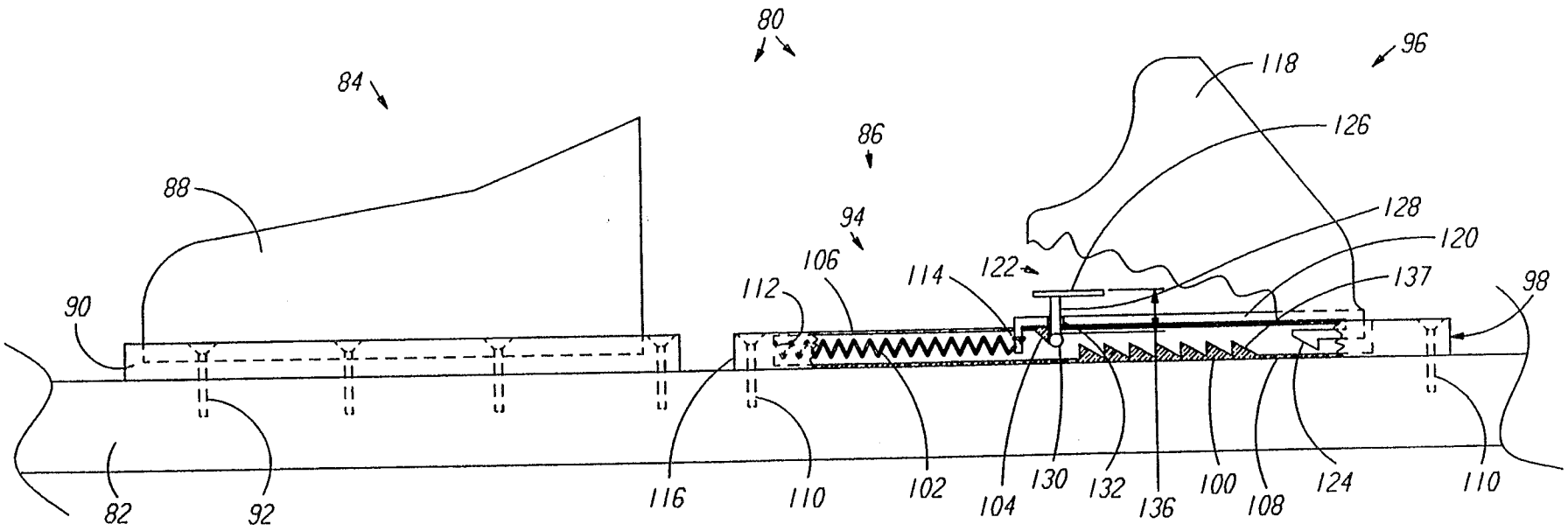
FIG. 4 is a partially cut away side view of a slidable step-in binding according to the present invention in an open position.

FIG. 4 is a partially cut away side view of a slidable step-in binding 80 according to the present invention. The slidable binding 80 is shown disposed upon a ski 82. The binding 80 includes a toe piece 84 and a sliding heelpiece 86. The toepiece 84 is permanently disposed in place on the ski 82. The sliding heelpiece 86 is disposed on the ski 82 aft of the toepiece 84.

The toepiece 84 includes a flexible upper 88 and a U-shaped clamp 90. The toepiece 84 is permanently secured to the ski 82. The flexible upper 88 is secured around its edges by the U-shaped clamp 90, which overlaps the edges of the upper 88. The U-shaped clamp 90 is secured to the ski 82 by a plurality of bolts 92 which pass through the clamp 90 into the ski 82. Such a toepiece is substantially similar to other toepieces and is well known in the art.

The sliding heelpiece 86 includes a base assembly 94 and an upper assembly 6. Together, the base assembly 94 and the upper assembly 96 function to secure and support the heel and lower rear foot of the skier when in the closed position (illustrated in FIG. 5). The base assembly 94 is disposed on the ski 82 to the rear of the toepiece 84. The upper is disposed on and slidably connected with the base assembly 94.

The base assembly 94 includes a track 98, a plurality of ratchet teeth 100, a spring 102, and a trigger lip 104. The track 98 has a top surface 106 and a bottom surface 108. The bottom surface 108 of the track 98 is secured to the ski 82 with a plurality of bolts 110. The trigger lip 104 is disposed on the top surface 106 of the track 98 toward the rear of the ski 82. The ratchet teeth 100 are disposed on the bottom surface 108 of the track 98 forward of the trigger lip 104. The spring 102 has a first end 112 and a second end 114. The first end 112 is attached to the track 98 at a forward wall 116. The second end 114 is attached to the upper assembly 96 of the sliding heelpiece 86. A compression, torsion or constant force spring can be used for the spring 102.

The upper assembly 96 includes an upper 118, a sole 120, and a trigger assembly 122. The sole 120 is slidably connected to the track 98. The upper 118 is disposed upon the sole 120 and connected thereto by a clamping between U-shaped plates secured with screws (not illustrated). The sole 120 has a downward facing pawl 124, which is attached to the sole 120. The trigger assembly 122 is operationally attached to the sole 120. The trigger assembly, 122has a trigger plate 126, an extension rod 128, and a pin 130. The trigger assembly 122 is disposed on the sole 120 such that the extension rod 128 passes through an opening 132 in the sole 120. The pin 130 is attached to the lower portion of the extension rod 128, and protrudes outwardly at an angle of 90 degrees with the extension rod 128. The trigger plate 126 is attached to the upper portion of the extension rod 128, forming an angle of 90 degrees with the extension rod 128. The extension rod 128 is of sufficient length 136 that the rod 128, pin 130 and trigger plate 126 are movable vertically upward and downward. The range of such movement is at least enough that the pin 130 will move below and disengage the trigger lip 104 when the trigger plate 126 is contacted with the sole 120.

In the open position, the upper assembly 96 is positioned at the rear of the track 98. The pin 130 is positioned behind the trigger lip 104 to prevent the force of the spring 102 from sliding the upper assembly 96 forward toward the toepiece 84, i.e., the pin 130 engages the trigger lip 104.

When the skier steps into the binding 80, the heel of the skier's foot contacts the trigger plate 126 and applies downward force thereto. In response to this downward force, the trigger assembly 122 slides downwardly until the trigger plate 126 contacts the sole 120. As the trigger plate 126 moves downwardly, the pin 130 moves beyond the trigger lip 104, i.e., the pin 130 disengages the trigger lip 104. When the pin 130 disengages the trigger lip 104, the force of the spring 102 moves the upper assembly 96 slidably forward along the track 98. As the upper assembly 96 moves slidably forward, the pawl 124 sequentially engages the ratchet teeth 100. The upper assembly 96 is disposed in the track 98 loosely enough that the pawl 124 and remainder of the upper assembly 96 slide up and over a slope 137 of each ratchet tooth 100. As the pawl 124 slides up and over each ratchet tooth 100, the pawl 124 engages the tooth. The upper assembly 96 is thus prevented from moving slidably rearward beyond the presently engaged tooth. However, those skilled in the art will appreciate that the sliding heelpiece 86 could provide substantial support to the skier's foot by the force of the spring alone, without the pawl 124 and ratchet teeth 100.

Figure 5:
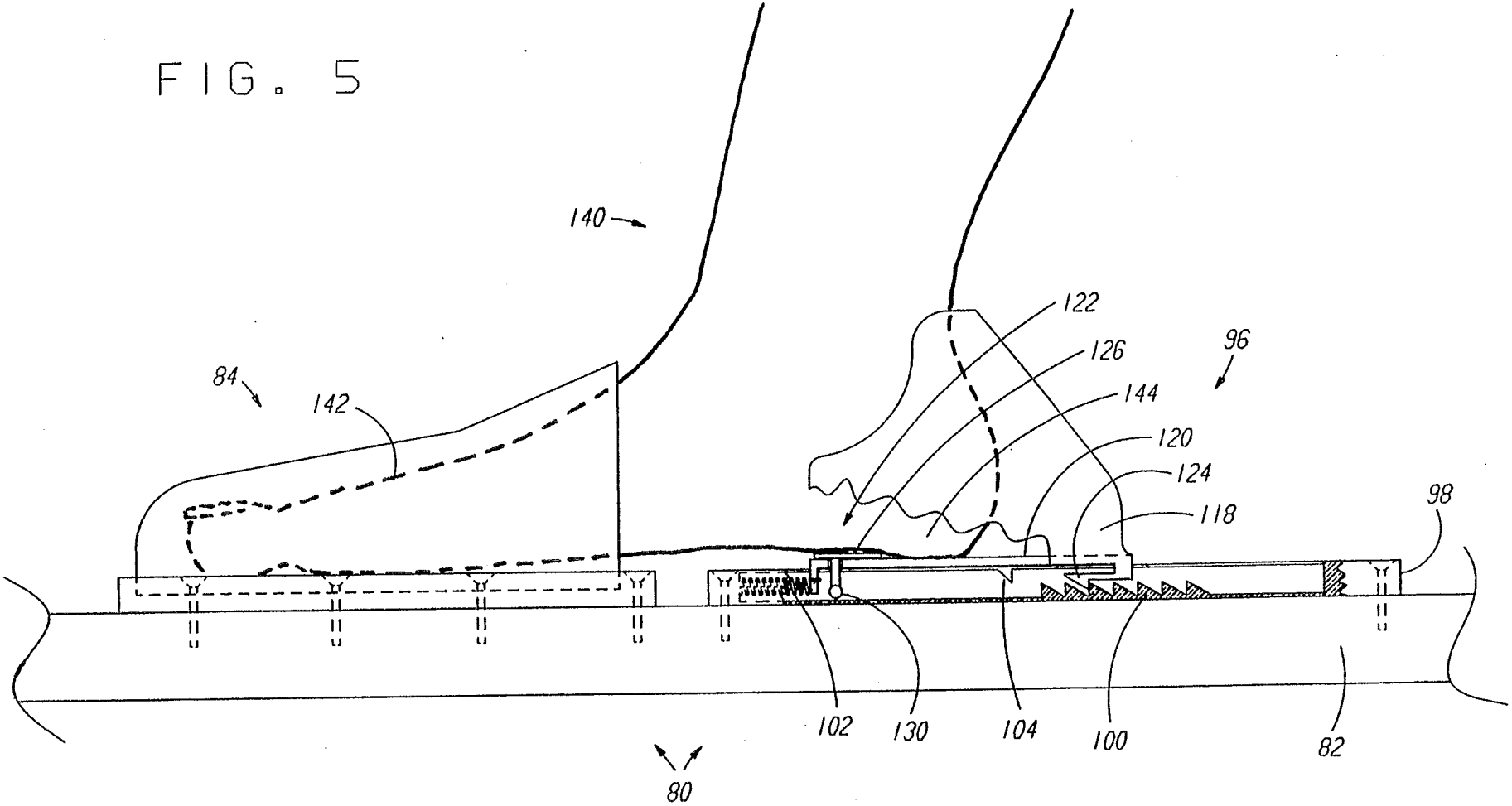
FIG. 5 is a partially cut away side view of the slidable step-in binding of FIG. 5 showing a closed position.

FIG. 5 is a partially cut away side view, showing underlying structure, of a skier's foot 140 secured in the slidable step-in binding 80 of FIG. 4. The binding 80 is thus shown in a closed position. In the open position, the upper assembly 96 is positioned at the rear of the track 98. The spring 102 exerts a closing force against the upper assembly 96. However, the upper assembly 96 is prevented from moving slidably forward by the engagement of the pin 130 behind the trigger lip 104. The pin 130 and trigger lip 104 hold the binding 80 in this open position until the skier is pulled from the water and steps into the binding 80.

To step into and secure the foot 140 in the binding 80, the skier first moves a front part 142 of the foot 140 into the toepiece 84 with a heel 144 of the foot 140 elevated (not illustrated). After so doing, the skier moves the heel 140 down against the trigger plate 126 and applies downward force thereto. The force applied by the skier's heel 144 pushes the trigger assembly 122 downward toward the ski 82 until the trigger plate 126 contacts the sole 120. At some point before the trigger plate 126 contacts the sole 120, the pin 130 moves beyond the trigger lip 104 and the pin 130 disengages the trigger lip 104. As the pin 130 disengages the trigger lip 104, the force of the spring 102 moves the upper assembly 96 slidably forward along the track 98 until the upper 118 contacts the heel 144. As the upper assembly 96 moves slidably forward, the pawl 124 sequentially engages the ratchet teeth 100. The upper 118 is disposed in the track 98 loosely enough that the pawl 124 and remainder of the upper assembly 96 slide up and over the ratchet teeth 100. As the pawl 124 slides up and over each ratchet tooth 100, the pawl 124 engages the tooth 100. While skiing, the weight of the skier against the sole 120 of the upper assembly 96 prevents the upper assembly 96 from moving upwardly in the track 98 by preventing the pawl 124 from disengaging the ratchet teeth 100. The upper assembly 96 is thus prevented from moving slidably rearward beyond the presently engaged tooth 100.

There are two ways in which the skier may exit the binding 80. The first occurs when the skier falls while skiing. The second occurs when the skier intentionally stops skiing. The upper 118 is constructed of a flexible material, such as plastic or vinyl. The upper 118 thus provides support to the skier's foot 140, but will not prevent the skier's foot 140 from exiting the binding 80 when a great deal of forward/upward or lateral force is applied to the foot 140. Such force is typically applied to the foot 140 as the skier falls at speed. Thus, the upper 118 flexes to allow the foot 140 to release from the binding 80 during a fall.

To intentionally exit the binding 80 after a successful skiing experience, the skier first comes to rest in the water. In the resting position, the skier's foot 140 exerts little downward force on the upper assembly 96. The skier then takes hold of the upper assembly 96 with the skier's hands, and pulls the upper assembly 96 away from the ratchet teeth 100 until the pawl 124 disengages the ratchet teeth 100. The upper assembly 96 fits loosely enough in the track 98 for this operation. Once the pawl 124 disengages the ratchet teeth 100, the skier slides the upper assembly 96 back along the track 98 toward the trigger lip 104 until the pin 130 engages the trigger lip 104. The skier may then easily remove the foot 140 from the binding 80.

Although the invention has been illustrated and described with respect to a best mode embodiment thereof, it should be understood by those skilled in the art that the foregoing and various other changes, omissions, and additions in the form and detail thereof may be made without departing from the spirit and scope of the invention.

What is claimed is:

1. A water ski binding for a water ski, which secures a skier's foot having a toe and a heel, comprising:

means for securing the toe, said toe securing means disposed on the ski;

means for pivotally securing the disposed on the ski, said heel securing means having a fore end and an aft end, said heel securing means pivoting away from the ski substantially near said aft end of said heel securing means; and means for engaging said heel securing means to the ski disposed on the ski, said engaging means preventing said heel securing means from moving pivotally;

said heel securing means including a base disposed on the ski, said base having a forward end and rear end, said base disposed on the ski, a hinge operationally connected to said base substantially toward said rear end, a heelpiece with a substantially rigid lip, said heelpiece operationally connected to said hinge to move pivotally, and a latch disposed on said base, said latch operative to engage said lip and prevent said heelpiece from moving pivotally when so engaged;

said hinge including a hinge pin and a hinge spring, both operationally connected to said heelpiece and said base, said spring operative to move said heelpiece pivotally away from said base when said latch is disengaged from said lip.

2. The water ski binding of claim 1, wherein said hinge includes a single piece of flexible plastic operationally connected to said heelpiece and said base, said flexible plastic having sufficient torsional flexibility and memory to move said heelpiece pivotally away from said base when said latch is disengaged from said lip.

3. The water ski binding of claim 1, wherein said latch includes an axle operationally connected to said base to move pivotally, a finger-like projection with a tooth member, said finger-like projection disposed on said axle to move pivotally with said axle, and a spring operationally connected to said latch and said base to move said latch pivotally toward said lip.

4. The water ski binding of claim 1, wherein said latch includes a finger-latch disposed on said base, said finger-latch having sufficient torsional strength and memory to engage said lip.

5. The water ski binding of claim 3, wherein said latch further includes a stop disposed on said finger-like projection, said stop preventing said tooth member from moving pivotally beyond said lip when said tooth member is contacted with said lip.

6. A water ski binding for a water ski, the binding having an open position where a skier's foot may enter said binding and a closed position where the foot is secured in said binding, the skier's foot having a front and a rear, comprising:

means for securing the front of the foot to the ski, said front foot securing means disposed on the ski;

means for securing the rear of the foot to the ski, said rear foot securing means slidably movable along, and disposed on, the ski;

means for applying force to slidably move said rear foot securing means toward said front foot securing means when the skier's foot enters said binding after "toward said front foot securing means" at line 11, said force applying means operationally connected to said rear foot securing means and the ski; and means for temporarily securing said rear foot securing means in the open position operationally connected to the ski, said temporary securing means releasable when the heel of the foot enters said binding, thereby releasing said rear foot securing means to the closed position.

7. The water ski binding of claim 6, wherein said rear foot securing means includes a sole, and an upper disposed on said sole.

8. The water ski binding of claim 7, wherein said force applying means includes a spring selected from the group consisting of compression springs, torsion springs and constant force springs.

9. The water ski binding of claim 8, wherein said temporary securing means includes a trigger plate 126 operationally connected to a trigger pin 130.

10. The water ski binding of claim 9, wherein said rear foot securing means further includes a pawl disposed thereon and the ski includes one or more ratchet teeth disposed thereon, said pawl engaging said ratchet teeth as said binding closes.

11. A water ski binding for a water ski, said binding having an open position and a closed position for securing a skier's foot, the foot having a heel, to a ski comprises:

a toe piece disposed on the ski;

one or more ratchet teeth operationally connected with the ski;

a track having a forward end and an aft end, said track operationally connected with the ski running in a direction substantially parallel with the ski;

a flexible heelpiece operationally connected with said track such that said heelpiece is slidably movable along said track;

a spring having a first end and a second end, said spring operationally connected on said first end with the ski and on said second end with said heelpiece such that said spring exerts a force against said heelpiece in a direction running from said aft end of said track toward said forward end of said track;

a pawl disposed upon said heelpiece such that said pawl engages said ratchet teeth when said heelpiece is moved slidably forward toward said forward end of said track;

a latch tooth disposed upon said track substantially toward said aft end of said track;

a trigger plate having a heel plate and a latch pin operationally connectable to said latch tooth, said trigger plate operationally attached to said heelpiece, said latch pin movable downward beyond said latch tooth when said heel plate is moved downward by the heel of the foot;

whereby said heelpiece is secured in the open position by said force applied to said latch pin by said spring through said heelpiece, and further whereby said heelpiece is released to the closed position by the heel of the foot when the heel pushes downward against said trigger plate such that said latch pin moves downwardly beyond said latch tooth and said spring pulls said heelpiece forward against the heel of the foot and said pawl engages said ratchet teeth.

* * * * *